United States Patent [19]

Scharling, II

[11] 4,256,148

[45] Mar. 17, 1981

[54] WEAVING APPARATUS AND METHOD

[76] Inventor: Henry E. Scharling, II, 123 Country Side Dr., Greenwood, S.C. 29649

[21] Appl. No.: 32,564

[22] Filed: Apr. 23, 1979

[51] Int. Cl.³ ..... D03D 47/34

[52] U.S. Cl. ..... 139/450; 139/452; 57/6

[58] Field of Search ..... 139/450, 1 R, 116, 224 A, 139/224 R, 453; 57/6, 289; 28/271

[56] References Cited

U.S. PATENT DOCUMENTS

| | | | |
|---|---|---|---|
| 3,099,907 | 8/1963 | Masurel et al. | 139/1 R |
| 3,291,160 | 12/1966 | Veney et al. | 139/224 A |
| 3,309,855 | 3/1967 | Stoll et al. | 57/289 |
| 3,455,340 | 7/1969 | Golobart | 139/453 |
| 3,467,147 | 9/1969 | Nydam | 139/116 |

*Primary Examiner*—Henry Jaudon

*Attorney, Agent, or Firm*—Bailey, Dority & Flint

[57] ABSTRACT

Apparatus and method is disclosed for weaving a unique fabric from basic yarns, rather than exotic yarns, wherein several yarns are combined or united at the loom into a single yarn, one or more of which may be delivered to the filling inserting means of the loom.

2 Claims, 6 Drawing Figures

WEAVING APPARATUS AND METHOD

BACKGROUND OF THE INVENTION

Yarns have long been united, compacted or intermingled and blended with other yarns either filament yarns or possibly spun yarns, often in connection with carpet yarns. Such has been disclosed in U.S. Pat. Nos. 3,309,855, 3,473,315, 3,824,776, 3,846,368 and 4,064,686 and many others. By combining or compacting basic yarns at the loom it is possible to effect style changes with a minimum of lead time as would be required if the yarns were combined on twisters and the like, or otherwise by air jets and then packaged for transport to the loom in the usual fashion. By placing the air jet or means combining the basic yarns into a composite or compacted yarn at the loom, it is possible to effect adjustments should the yarn fail to possess the desired characteristics or effect, thus avoiding the manufacture of considerable amounts of yarn or fabric which does not produce the desired end result. By changing the direction in one of the passageways into which the air jet is introduced, it is possible to effect changes in direction of the yarn passing thereby causing changes in the characteristics of the yarn and resulting fabric.

SUMMARY OF THE INVENTION

It has been found that yarns may be compacted or otherwise joined at the loom in order to weave a fabric from basic yarns of the type which has formerly required the utilization of expensive exotic yarns. An apparatus is provided for weaving fabric of compacted yarn formed from a plurality of yarns carried by a creel adjacent a loom. An air jet device for receiving a plurality of yarns from the creel and uniting them into a single yarn is provided together with means mounting the air jet device at the loom. Yarn feeding and delivering means is also carried at the loom for moving the yarns from the creel to the air jets and thence as a single yarn to the filling inserting means for weaving. By feeding a number of yarns from a creel adjacent the loom and then subjecting, at the loom, a plurality of yarns to the action of an air jet compacting the plurality of yarns into a single yarn and then delivering the single yarn to a filling or weft inserting mechanism of the loom, a highly attractive fabric may be woven with improved production rates from less expensive yarn. The novel fabric produced thereby achieves an appearance of random design with improved dimensional stability.

Accordingly, an important object of this invention is to produce improved fabric by positioning yarn texturizing apparatus adjacent or on the loom avoiding the use of a twister and winder. The spaced effect of an air jet compacting or yarn integrating device may also be achieved at the loom. Since yarns having different shrinkage characteristics are often employed in achieving high style fabric, it is possible to achieve greater dimensional stability through the apparatus and method hereof. Several yarns may be combined into two or more yarns for multiple filling insertion simultaneously thus increasing productivity.

By selecting basic or component yarns a composite yarn may be achieved for immediate use by the loom. Effect yarns may be combined with core yarns for greater weaveability. Natural and synthetic, filament or spun yarns may be combined as desired eliminating operations and saving time.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Apparatus for weaving fabric of compacted yarn formed from a plurality of yarns carried by a creel adjacent a loom having filling inserting means includes an air jet device A for receiving a plurality of yarns from the creel and uniting the yarns into a single yarn. Mounting means B are provided for carrying the air jet device on or adjacent the loom. Yarn feeding and delivering means C are also carried at the loom for moving said plurality of yarns from the creel to the air jet device and thence as a single yarn to the filling inserting means for weaving.

Figure 1:
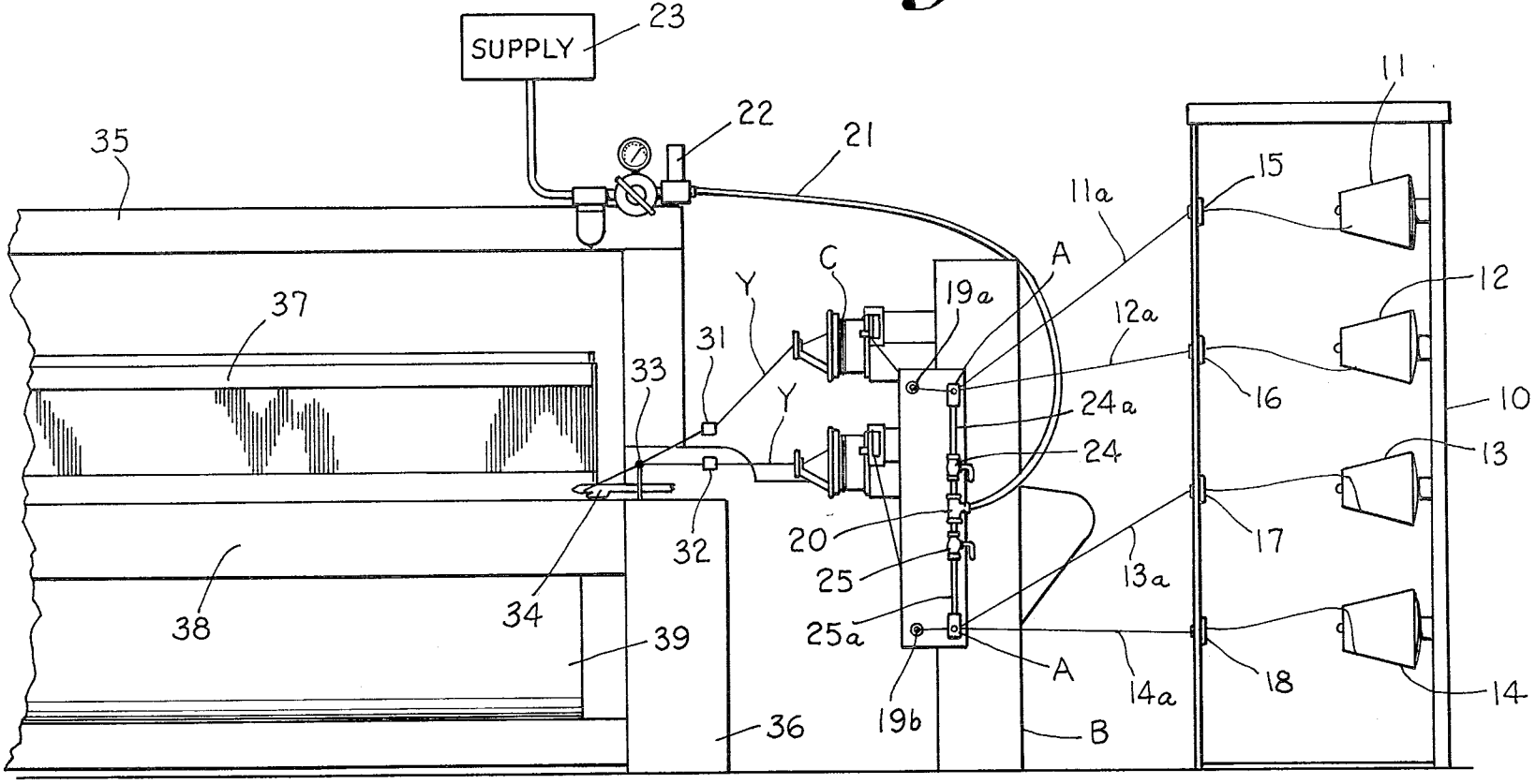
FIG. 1 is a schematic front elevation illustrating a loom and a creel positioned adjacent the loom with means constructed in accordance with the present invention for combining basic yarns from the creel and feeding same to weft inserting means in this instance, in the form of a rapier into cloth being woven on the loom.
Figure 2:
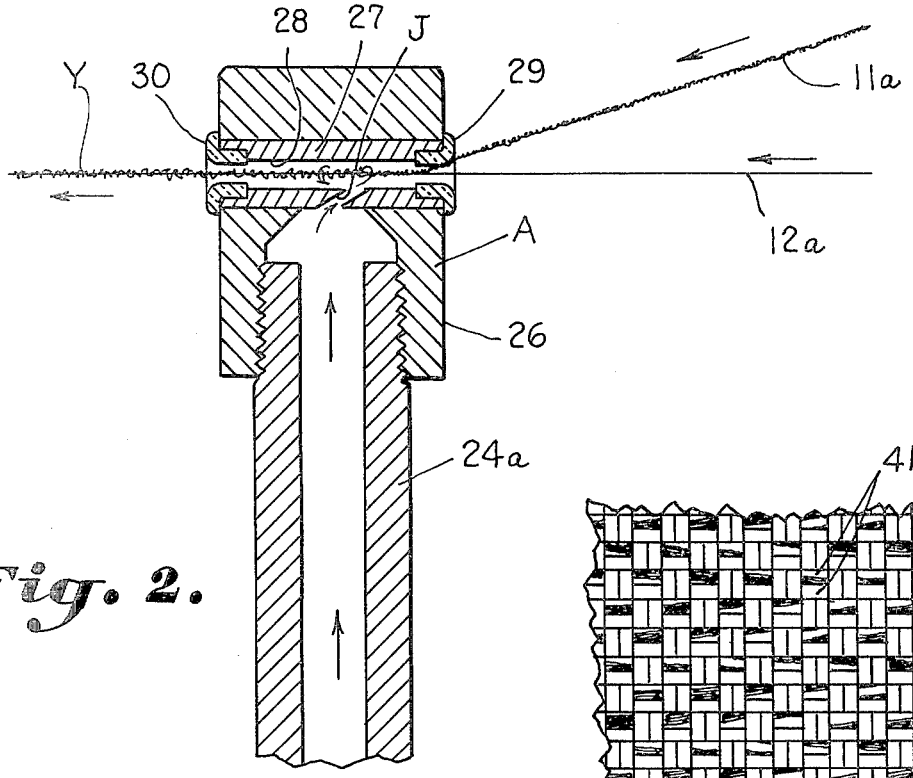
FIG. 2 is an enlarged longitudinal sectional elevation illustrating an air jet device for receiving a plurality of yarns from the creel and uniting them into a single yarn through the application of an air jet delivered at an angle which in this instance is opposed to the direction of travel of the yarns to the yarn feeding apparatus for delivering yarns to the filling inserting means of the loom.
Figure 3:
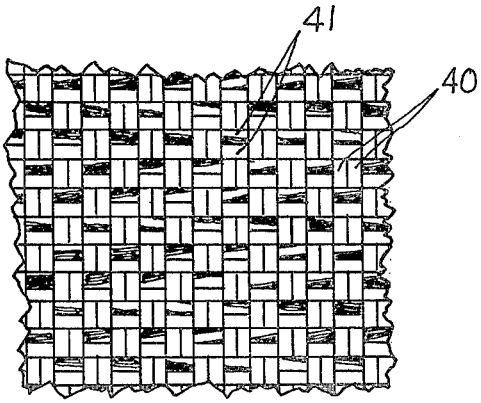
FIG. 3 is a diagram illustrating a fabric in the form of a basket weave from filling yarn which has been combined in accordance with the invention with insertion of two filling yarns at a time into the shed during weaving.

Referring more particularly to FIG. 1, a creel is illustrated positioned at the loom and including an upright member 10 having means for supporting a plurality of packages of yarn illustrated respectively at 11, 12 and 13. The yarn passes through respective eyes 15, 16, 17 and 18 carried in an upright yarn guide 19. Upper and lower pairs of yarns illlustrated at 11*a*, 12*a* and 13*a*, 14*a*, respectively, are fed to upper and lower air jet devices carried by the mounting means B which is illustrated in the form of an upright standard. The mounting means B carries a pipe coupling illustrated as a T member 20 receiving compressed air through a line 21 through a solenoid valve 22 from a suitable supply of compressed air designated at 23. The solenoid valve 22 is provided so that when the loom stops for any reason, the supply of air through the line 21 will be discontinued automatically. Upper and lower manually operated valves illustrated at 24 and 25, respectively, are illustrated for supplying air through the lines 24*a* and 25*a* to the air jet devices. The air jet devices A are illustrated in FIG. 2 and include a sleeve 26 being internally threaded for reception upon the line 24*a* as illustrated, or the line 25*a* and the like. The sleeve 26 which is illustrated as being cylindrical carries a tubular member 27 for defining a longitudinal yarn passageway 28 therein. The air jet is introduced into the passageway 28 from an angular passageway J in FIG. 2. A ceramic yarn guiding member 29 is illustrated as receiving the yarns 11*a* and 12*a* from the creel and joining them as a composite yarn Y to be fed to a filling inserting member of the loom. As exit eye 30 is provided from which the yarn Y is delivered. The air jet may be introduced at any angle to the yarn or even axially thereto to achieve the desired effect.

Figure 2A:
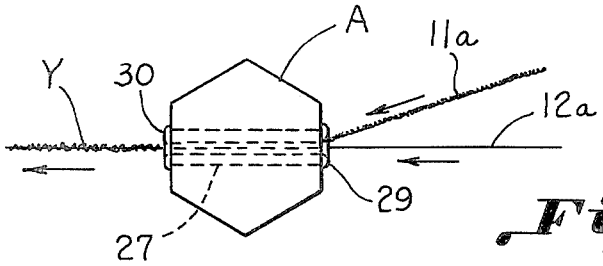
FIG. 2A is a top plan view of the air jet device illustrated in FIG. 1 with the yarns moving in the same direction as the longitudinal axis of the passageway of the air jet device.
Figure 2B:
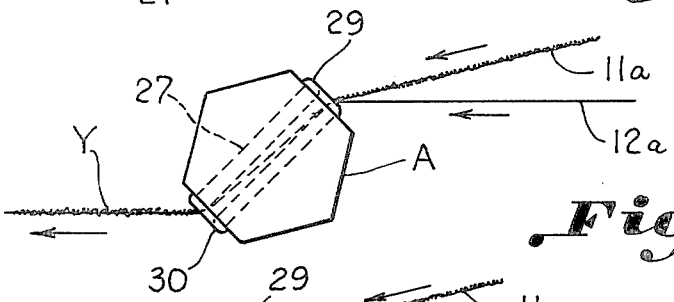
FIG. 2B is a top plan view of the air jet device similar to FIG. 2A turned at an angle so that the yarns from the creel enter the passageway at an angle to the longitudinal axis of the passageway.
Figure 2C:
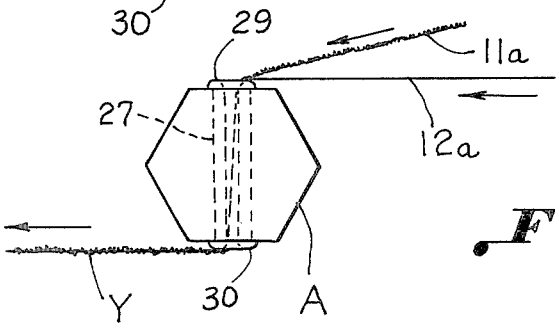
FIG. 2C is a top plan view illustrating an air jet device with the yarns being introduced to the passageway and directed therealong at a 90 degree angle to the yarns being introduced and at a 90 degree angle to the yarns being delivered therefrom to the loom.

From the exit eyes 30 the composite yarns pass to respective eyes 19*a* or 19*b* or a vertical yarn guide from whence the yarn is delivered to a yarn feeder C. If it is desirable to vary or correct the characteristics or appearance of the composite yarn, the angle of the passageway may be adjusted as illustrated in FIGS. 2A, 2B and 2C. This may be accomplished by turning the air jet on the line on the threaded connection. It may also be possible to intermittently draw the yarn past the air jet to vary the effect or construction of the composite yarn by using another form of yarn feeder although the constant uniform feed is believed to be important.

The yarn Y is delivered to the filling inserting means by way of any suitable filling stop motion apparatus such as the Eltex vibrating stop motion illustrated at 31 and 32 (FIG. 1). The yarns Y then pass through an eye 33 at the loom and are illustrated as passing to the giver rapier 34 of a rapier loom. The loom is illustrated as including the usual arch 35, end frame 36, harnesses 37, breast beam 38, with the cloth illustrated at 39 passing to a suitable takeup, not shown.

It is understood that the yarn feeders C may possibly be omitted if a yarn winder and the like, such as the Unifill yarn winder, is provided so that the yarn may be fed for subjection to the action of the air jet. It would appear that, if the Unifill winder is used, only one composite yarn as a filling could be inserted at a time. In this intance a Savi prewinder or yarn feeder is illustrated for uniformly taking yarn from the creel and constantly feeding same past the air jet. In this instance, an effect yarn is illustrated in the form of a spun yarn 11*a* and a carrier yarn in the form of polyester filament yarn is illustrated at 12*a*. Such yarns are combined and inserted as one of two composite yarns simultaneously inserted as filling yarn as illustrated in FIG. 1. The loom may be in the form of a fly shuttle loom, but it is preferred that a rapier loom, such as a Gunne loom, having a rigid rapier of the type illustrated wherein the filling is delivered by a giver rapier for center transfer to a taker rapier (not shown).

The cloth illustrated in the drawings is a basket weave wherein the wrap yarns are illustrated at 40 and the filling yarns are illustrated at 41 being constructed of a pair of composite yarns Y which are inserted simultaneously. Thus, the composite yarns Y may be compacted yarn formed by the intermingling of a spun yarn and a filament yarn or two filaments or two spun yarns. The usual situation would consist of respective composite yarns formed as from a dyed yarn or effect yarn of any desired type, and a stronger core yarn or carrier yarn. It is thus possible to make predyed or finished fabric at the loom in considerably less time than would be possible using prior techniques. The fabric hereof appears, if a uniformly dyed yarn is used in a composite strand, to have a random pattern which has heretofor been achieved utilizing only expensive exotic yarns. The warp may be of any desirable yarn and a textured polyester filament yarn has been found to be satisfactory.

While a preferred embodiment of the invention has been described using specific terms, such description is for illustrative purposes only, and it is to be understood that changes and variations may be made without departing from the spirit or scope of the following claims.

What is claimed is:

1. Apparatus for weaving fabric of compacted yarn formed from at least four yarn packages carried by a creel adjacent a loom having filling insertion means comprising:

at least two air jet devices for receiving a plurality of yarns from said creel and uniting said yarns into a single yarn;

means mounting said air jet devices at the loom;

an air supply for said air jet devices which is discontinued when said loom is stopped;

at least two yarn feeders serving a said yarn feeding and delivering means; and a rapier receiving at least two yarns from said yarn feeders for insertion simultaneously.

2. The structure set forth in claim 1 wherein said air jet device includes an elongated passageway into which air is introduced at an angle to a longitudinal axis of said passageway and means for varying the angular disposition of said passageway to said plurality of yarns moving from the creel and thence as a single yarn for varying the characteristics of the fabric.

* * * * *